United States Patent [19]

Shamir et al.

[11] Patent Number: 4,962,756

[45] Date of Patent: Oct. 16, 1990

[54] CONTINUOUS PASSIVE MOTION DEVICE FOR IMPARTING A SPIRAL MOTION TO THE DIGITS OF THE HAND

[75] Inventors: Dan Shamir; Mark W. Groves, both of Columbus, Ohio

[73] Assignee: Danninger Medical Technology, Inc., Columbus, Ohio

[21] Appl. No.: 308,437

[22] Filed: Feb. 9, 1989

[51] Int. Cl.[5] ..... A61H 1/02

[52] U.S. Cl. ..... 128/26

[58] Field of Search ..... 128/26, 25 R, 48, 49, 128/77; 272/69

[56] References Cited

U.S. PATENT DOCUMENTS

| | | | |
|---|---|---|---|
| 3,756,222 | 9/1973 | Ketchum | 128/26 |
| 4,576,148 | 3/1986 | Koerner et al. | 128/26 |
| 4,644,938 | 2/1987 | Yates et al. | 128/26 |
| 4,665,900 | 5/1987 | Saringer | 128/26 |
| 4,679,548 | 7/1987 | Pecheux | 128/26 |
| 4,724,827 | 2/1988 | Schenck | 128/26 |

FOREIGN PATENT DOCUMENTS

| | | | |
|---|---|---|---|
| 78093 | 5/1983 | Canada | 128/25 R |

OTHER PUBLICATIONS

Publication-"The Simple Machine, Kinetic Hand and Wrist Continuous Passive Motion Machine".

*Primary Examiner*—Richard J. Apley
*Assistant Examiner*—H. N. Flaxman
*Attorney, Agent, or Firm*—Daniel J. Hudak Co.

[57] ABSTRACT

A portable CPM machine is presented for causing controlled continuous passive motion of one or more of the digits of a patient's hand. The device is mounted on the dorsal surface of the hand for motion of the four fingers and is mounted on the palmar aspect of the forearm for motion of the thumb. The thumb use is independent of finger use in that the device is mounted in a different location and the axis of rotation is about a line which is perpendicular to the frontal or sagittal plane of the forearm. The mounting for use with the thumb has the device mounted on the palmar surface of the forearm parallel to the longitudinal axis of the forearm. In both instances, the device is supported by a splint on the user's hand which extends along the forearm. The device has a housing with an actuating mechanism located within the housing. The actuating mechanism comprises a reciprocating linear actuator which is linked to a rotary actuator so that for finger use the device is rotated about an axis located on the user's hand and transverse to the longitudinal axis of the user's arm and simultaneously an actuating arm which is linked to one or more digits driven back and forth. This actuating mechanism achieves a spiral motion which is imparted to the end of the digit or digits in therapy. The motion of the actuating arm allows for flexion and extension of each of the digital flanges. A spiral motion is imparted to the thumb in a plane parallel to the frontalplane of the user's hand as the device is rotated about an axis substantially transverse to the frontal plane and the actuating arm undergoes reciprocation.

6 Claims, 3 Drawing Sheets

CONTINUOUS PASSIVE MOTION DEVICE FOR IMPARTING A SPIRAL MOTION TO THE DIGITS OF THE HAND

FIELD OF THE INVENTION

The present invention relates to a continuous passive motion (CPM) device to cause passive motion of the digits of a hand, and more particularly to a device which causes a spiral motion of the digits to achieve complete flexion and extension of each of the flange joints.

BACKGROUND

It has been recently discovered that passive motion of a joint reduces the post-trauma accumulation of fluid and subsequently reduces the recovery time. This form of therapy has received acceptance as an advantage to the patient and a cost savings in the health care field. In particular, devices are commercially available to produce movement in the hip, knee, and ankle. A limited number of devices are available to produce movement in the digits of a hand. The problems in designing such hand devices are that the movement of the fingers and thumb are very complex and the distance traveled is relatively small. Thus, it is difficult to design a machine which is not cumbersome and heavy, and which will achieve the desired motion. It is also a problem to design such a device which is not too complex and that will stand up to the rigors of continuous use.

U.S. Pat. No. 4,644,938 issued Feb. 24, 1987 to Lubbers relates to a device to cause continuous passive motion of the hand. The device operates using an elastic biasing force which tends to pull the finger into a flexed position and a counter force which is intermittently applied to overcome the biasing force and pull the fingers into an extended position.

U.S. Pat. No. 4,665,900 issued May 19, 1987 to Saringer relates to a device mounted on the palmar side of the forearm. The device uses an elongated rod to push and pull the finger in and out of flexion and extension.

The present invention provides an elegant and durable mechanism to cause continuous passive motion of one or more digits and further a mechanism which approximates the spiral motion travelled at a point near the distal end of a digit to achieve complete flexion and extension.

Further objects and advantages of the invention may be presented and discussed hereinafter.

SUMMARY OF THE INVENTION

A portable CPM machine is presented for causing controlled continuous passive motion of one or more of the digits of a patient's hand. The device is mounted on the dorsal surface of the hand for motion of the four fingers and is mounted on the palmar aspect of the forearm for motion of the thumb. The thumb use is independent of finger use in that the device is mounted in a different location and the axis of rotation is about a line which is perpendicular to the frontal or sagittal plane of the forearm. The mounting for use with the thumb has the device mounted on the palmar surface of the forearm parallel to the longitudinal axis of the forearm. In both instances, the device is supported by a splint on the user's hand which extends along the forearm. The device has a housing with an actuating mechanism located within the housing. The actuating mechanism comprises a reciprocating linear actuator which is linked to a rotary actuator so that for finger use the device is rotated about an axis located on the user's hand and transverse to the longitudinal axis of the user's arm and simultaneously an actuating arm which is linked to one or more digits driven back and forth. This actuating mechanism achieves a spiral motion which is imparted to the end of the digit or digits in therapy. The motion of the actuating arm allows for flexion and extension of each of the digital flanges. A spiral motion is imparted to the thumb in a plane parallel to the frontal plane of the user's hand as the device is rotated about an axis substantially transverse to the frontal plane and the actuating arm undergoes reciprocation.

DETAILED DESCRIPTION OF THE INVENTION

Figure 1:
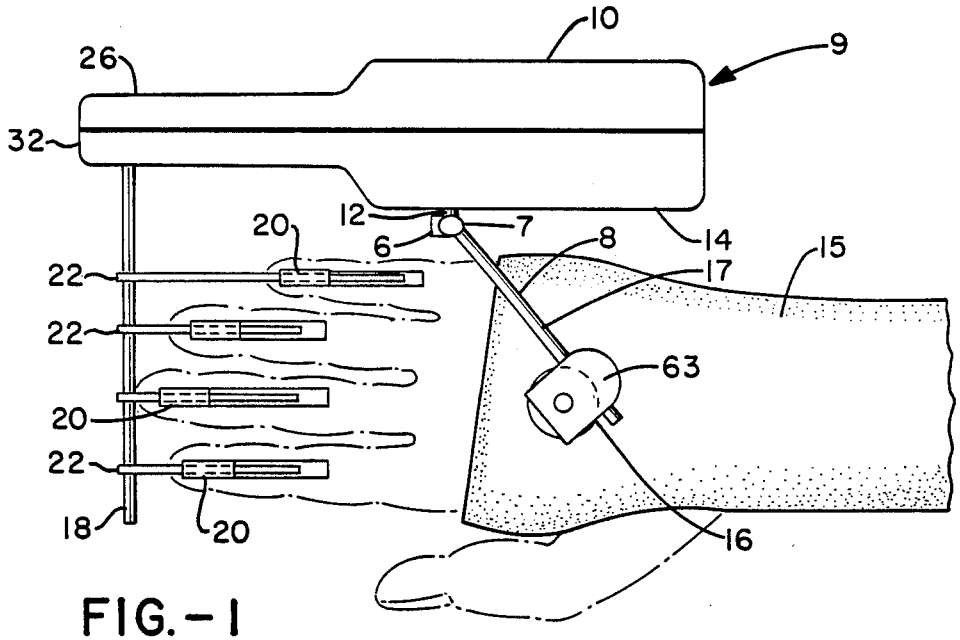
FIG. 1 shows a top view of the device in accordance with the invention mounted on the ulnar aspect of a user's hand for use on the fingers.
Figure 2:
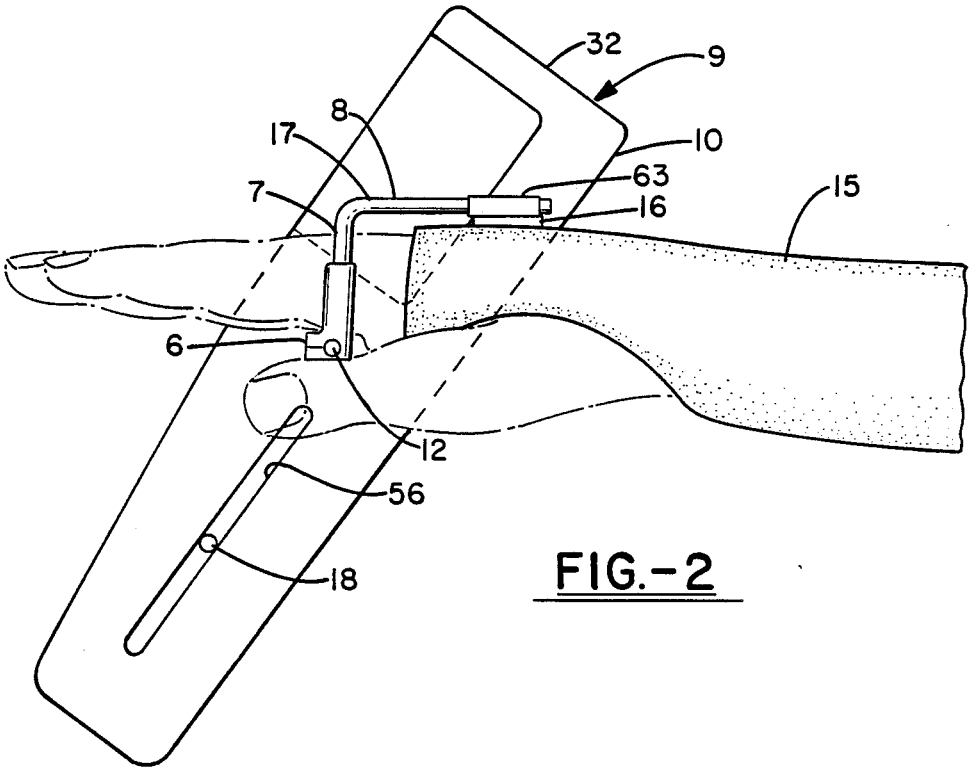
FIG. 2 shows a side view of the CPM device mounted on the ulnar aspect of a user's hand for use with the fingers.

The CPM device of the present invention is shown generally at 9 as it is mounted on the arm for finger use, and in particularly on the ulnar aspect of the hand and forearm of the user. The device includes a housing 10 which is mounted from a rotator shaft 12 which extends from a lateral side 14 of the housing 10. The rotator shaft 12 engages a mount 16 which is attached to the dorsal side of a splint or support 15 which engages the user's hand and forearm for finger use.

The mount 16 for use with the finger use comprises a pivot arm 17 having a first clamp 6 which has an axis located anterior to the user's hand, a transverse first length 7, and a second length 8 transverse to the first length and which has an acute interior angle with respect to the axis of the first clamp. The second length 8 engages a second pivot clamp 63 located on the dorsal side of the user's hand and attached to the splint 15. The second length 8 can be axially adjusted in the second clamp, and likewise the anterior angle can be adjusted by rotating the clamp 63. Likewise the height of the first clamp 6 can be adjusted on the first length 7 of the pivot arm. The position of this clamp can be subsequently locked by a locking ring. The mount 16 is adjusted so that the axis of rotation corresponds to the axis defined when the fingers are curled into the palm as if to grasp a rod. The position of the mount is subsequently locked. Thus, the mount can be adjusted to compensate for the various shapes and sizes of hand with which it will be used.

The rotator shaft 12 constitutes an axis of rotation which is transverse to the medial, i.e. the longitudinal plane of the user's arm. When the device is in use, it rotates about the rotator shaft 12.

Spaced apart from the rotator shaft 12 is an actuating arm 18 which extends substantially parallel to the rotator shaft 12. The actuating arm 18 operatively engages one or more of the digits of the user by means of one or more finger attachments 20 which have a bearing surface 22 that captures the end of the actuating bar 18. The finger attachments 20 also include an intermediate telescoping portion operatively joined to a base which is adhered to the finger of the user. The telescoping finger attachments permit a straight actuating bar 18 to be used to drive all of the fingers through flexion and extension although the fingers are of varying length.

The housing 10 is made of an injected plastic, such as an acrylonitrile-butadiene-styrene terpolymer ("ABS"), and includes a first section 26 and a second section 32. The first and second sections 26 and 32 are made to form the housing 10 which contains the actuating mechanism 40. The housing 10 is molded so that it may include integral functional elements. For example, a motor 42 is mounted in a motor mount section 34 of the housing. The motor 42 is a battery driven electrical motor which is driven by two 1.5 batteries. The motor 42 engages a drive screw such as an acme screw 43 which is mounted in thrust bushings and journal bearings 36 and 38 mounted in the housing 30.

Figure 6:
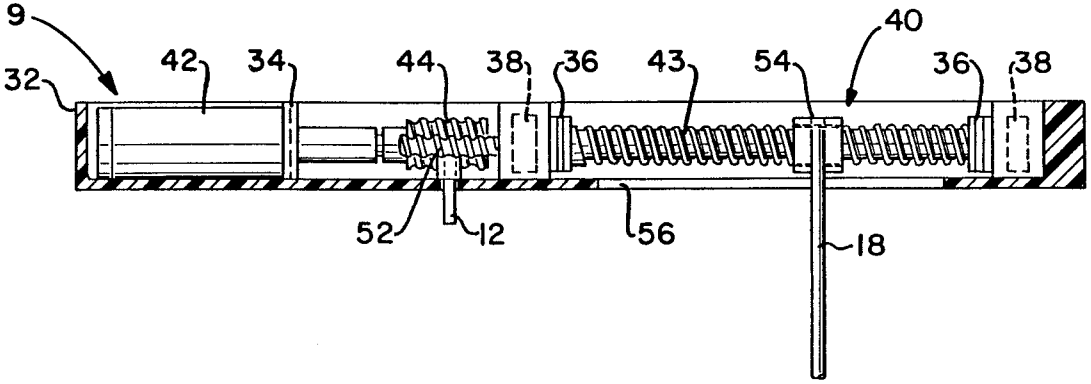
FIG. 6 shows a cross-section at line 1—1 of FIG. 5.

The motor also engages a worm 44 which engages a worm gear 52 which is attached to the rotator shaft 12 and the worm 44 rotates about the worm gear 52 and the transverse axis of rotation, i.e., the axis defined by rotator shaft bar 12. Thus, when the motor 42 drives the acme screw 43 and the worm 44 about the worm gear 52, the device 9 is rotated about the axis of the rotator shaft 12. Simultaneously, a traveler 54 which engages the acme screw 43 is driven in linear reciprocation by the rotation of acme screw 43. The traveler also engages a bearing beam 48. The traveler 54 travels back and forth on the acme screw 43 and reverses when the motor reverses. The actuating arm 18 is carried by the traveler and extends from the traveler through a slot 56 in the cover 32 to the finger of the user. The linkage of the linear and the rotary actuation causes the actuating arm 18 to be rotated in a spiral motion as illustrated in reduced scale in FIG. 6. The actuating arm, which is attached to the fingers by the telescoping finger attachments then causes the fingers to be pushed into flexion and pulled into extension following the spiral path. The spiral motion approximates the natural motion of the digits as they are moved through flexion and extension by the user. The motion exercises each of the flanges of the digit as it is moved through flexion and extension. This is an extreme advantage in recuperative therapy.

The length of travel of the traveler along the acme screw is controlled by a solid state relay circuit 72. Thus, when the desired limit of the flexion is encountered, the relay reverses the direction of the motor and consequently the direction of the rotation of the acme screw as well as rotation of the housing about the rotator shaft 12. Further, it can be seen that the shape of the spiral, i.e. ratio of the rotational aspect to the linear aspect of motion, can be controlled by the gearing of the worm gear 52.

Figures 3, 4, 7:
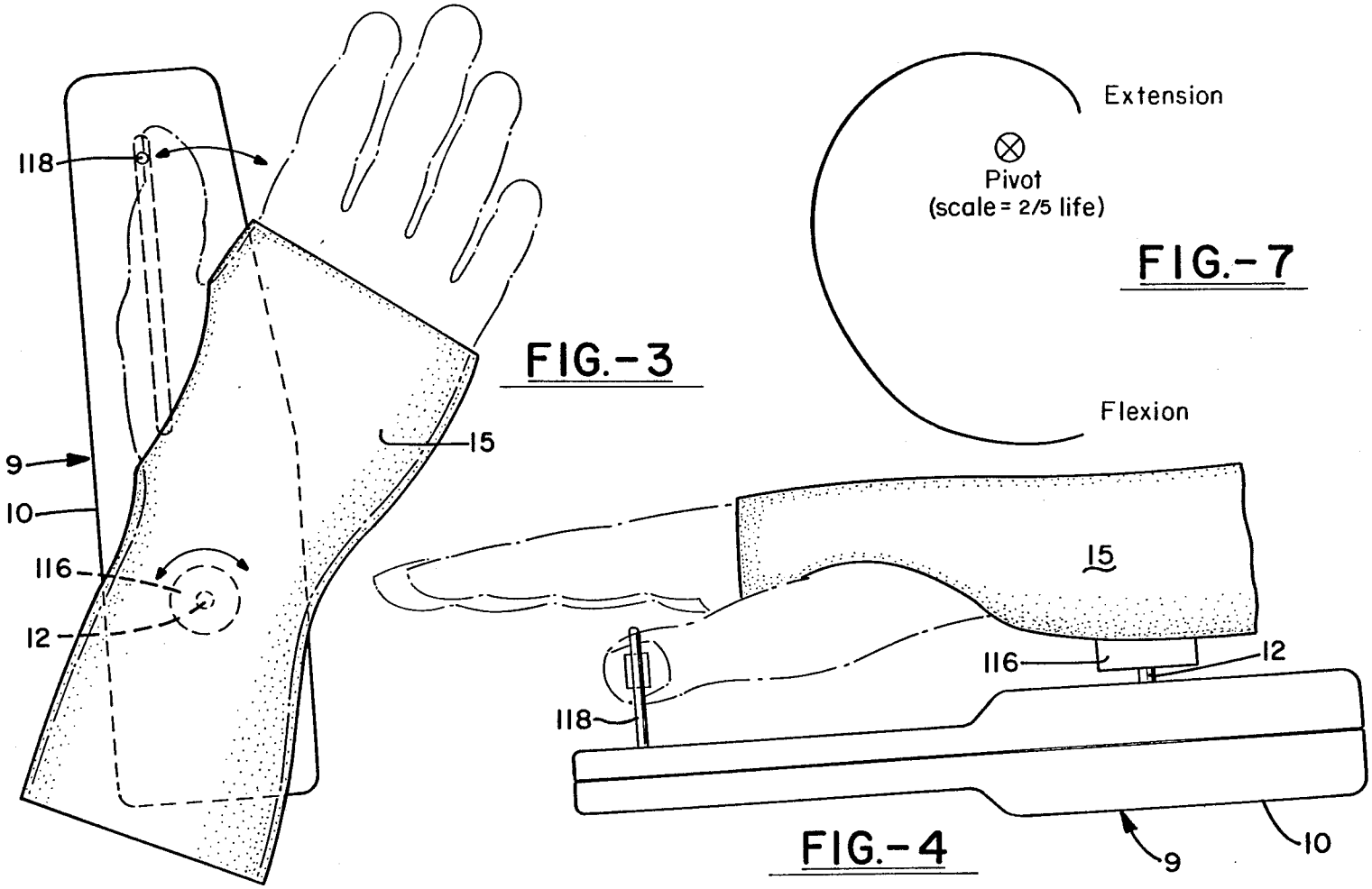
FIG. 3 shows a bottom view of the device mounted on the palmar aspect of the user's hand for use on the thumb.
FIG. 4 shows a side view of the device mounted on the palmar aspect of the user's hand for use on the thumb.
FIG. 7 shows a reduced scale spiral curve which is the motion achieved at the link between the actuating bar and the finger by the device of the present invention.
Figure 5:
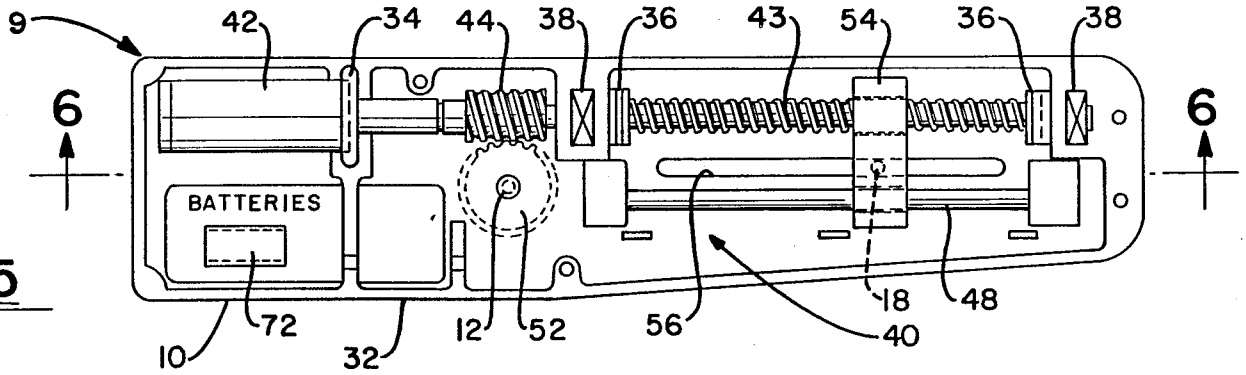
FIG. 5 shows a top plan view of the CPM device with the cover of the housing removed to show the actuating mechanism.

As is shown in FIG. 3 and FIG. 4, the device is mounted on the palmar aspect of the forearm for motion of the thumb. The device thus rotates in a plane parallel to the plane of the user's hand about an axis transverse to the plane. The thumb is drawn by a finger attachment through a spiral which is shortened from that traveled when the device is used on the fingers. For use with the thumb, the device is attached to a mount 116 on the palmar side of the splint. The mount 116 comprises a splint pivot clamp 106 which engages the rotator shaft 12. The actuating arm 118 is shortened so as to preclude interference with the fingers.

As an alternative embodiment of the invention, the linear actuator could comprise a belt drive. Of course, it should be understood that the belt drive can be a toothed-belt or a linked chain. Similarly, the motor may be mounted outside the housing on a axis parallel to the pivot bar and appropriate gearing may be used to drive the actuators.

The batteries used to drive the motor are mounted in a compartment 60 in the housing 10 and are thus concealed.

The relay circuit further includes a reversing mechanism so that the motor will reverse upon encountering a preset load as a further means of protecting the user from over stressing the user's fingers.

While in accordance with the Patent Statutes, the best mode and preferred embodiment has been set forth, the scope of the invention is not limited thereto, but rather by the scope of the attached claims.

What is claimed is:

1. A device capable of being carried on the arm of a user for causing passive flexion and extension of a user's digit, said digit being a member of a hand having the lateral edge, said device comprising:

a motor driven actuator contained within a housing, said housing being operatively joined to support means for substantial support by the dorsal surface of the user's arm, means linking said actuator with said digit, said actuator including means for causing a linear element of actuation and a rotational element of actuation such that the operation of the motor causes said actuator to drive said digit in a spiral about an axis of rotation.

2. A device as set forth within claim 1 wherein said housing has a lateral edge which is substantially aligned with the lateral edge of the user's hand and the operation of the motor causes said housing to be rotated about said axis of rotation.

3. An actuator as set forth in claim 2, wherein said linear element is caused by a linear actuator which is linked by a transmission to a shaft which is coaxially aligned with said axis of rotation, and a motor drives the linear actuator and the housing about said axis of rotation, said shaft being operatively connected to a support which engages at least a portion of said user's arm.

4. A device as set forth in claim 3, wherein said transmission comprises a set of gears, the ratio of which determines the travel of the point in the longitudinal direction relative to the amount of rotation about said axis of rotation.

5. A device as set forth in claim 4, wherein said actuator includes load reversal which reverses said motor in response to a preset load.

6. A device as set forth in claim 5, wherein said linear actuator comprises a drive screw which is driven by said motor and a traveler which reciprocates along the axis of said drive screw, said traveler being operatively linked to said rod to cause reciprocation of said rod.

* * * * *